United States Patent [19]

Persson

[11] 4,359,023

[45] Nov. 16, 1982

[54] TROUGH-SHAPED SHEET METAL COMPONENT WITH A DEEPER AND A SHALLOWER PORTION

[75] Inventor: Bengt G. Persson, Olofström, Sweden

[73] Assignee: AB Volvo, Gothenburg, Sweden

[21] Appl. No.: 142,890

[22] Filed: Apr. 23, 1980

[51] Int. Cl.[3] ..... E01M 11/06

[52] U.S. Cl. ..... 123/195 C; 184/106; 184/65

[58] Field of Search ..... 220/1 C, 1 R, DIG. 13; 123/195 C; 184/65, 106

[56] References Cited

U.S. PATENT DOCUMENTS

| | | | |
|---|---|---|---|
| 3,354,988 | 11/1967 | Leonard | 184/106 |
| 3,422,806 | 1/1969 | Lorean | 123/195 C |
| 3,653,464 | 4/1972 | Jacobsen et al. | 184/106 |
| 3,724,599 | 4/1973 | Heidacker | 123/195 C |
| 4,121,557 | 10/1978 | Congram et al. | 123/195 C |
| 4,280,453 | 7/1981 | List et al. | 123/195 C |

*Primary Examiner*—Leon Gilden
*Attorney, Agent, or Firm*—Young & Thompson

[57] ABSTRACT

A trough-shaped sheet metal component with a deeper and a shallower portion such as an oil pan for combustion engines, and a method of deep-drawing it. In the transition between the deeper and the shallower portion, the edge between the bottom of the shallower portion and its side walls is made with a much shorter radius than the central portion. In deep-drawing the shallower portion and the transitional area, a pressure pad is used in the transitional area, where the material is locked in between die and pressure pad, so that working only takes place by bending in the edge areas.

1 Claim, 6 Drawing Figures

TROUGH-SHAPED SHEET METAL COMPONENT WITH A DEEPER AND A SHALLOWER PORTION

Figure 2:
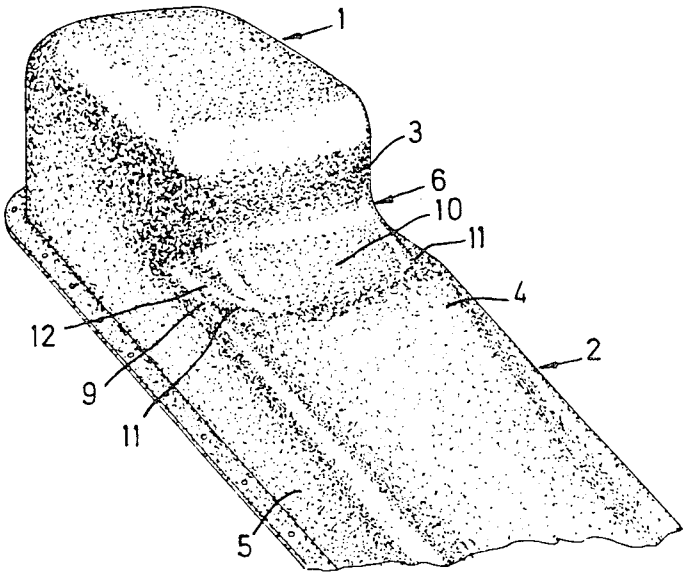

The present invention relates to a trough-shaped sheet metal component with a deeper and a shallower portion, for example an oil pan for combustion engines, comprising longitudinal side walls, forward and rear end walls and a transverse wall with a transitional area to the bottom of the shallower portion.

Up to now, deep-drawing oil pans have been made with gentle transitions, i.e. with a relatively large radius of curvature, both between the bottom of the shallower portion and the rear wall of the deeper portion and between the bottom of the shallower portion and its side walls in this area. Such oil pans are made in two shaping operations. In a first operation, the deeper portion is pre-drawn out of a sheet metal blank and in a second operation the deeper portion is completely drawn at the same time as the shallower portion with the transitional area to the deeper portion is drawn.

In the first operation the transition to the portion, which is later to form the bottom of the shallower portion, must be made quite gentle, which makes it easy for rupturing or wrinkles to occur in the transitional area if the part is not annealled intermediately before the second shaping operation. This is especially true of oil pans for truck engines, which have quite irregular shapes and where maximum depth is desirable in the deeper portion. Consequently, it is necessary to anneal the part prior to the second drawing operation.

The purpose of the present invention is to provide a trough-shaped sheet metal component of the type described in the introduction, with such a shape that the necessity of annealling between the two drawing operations can be eliminated without creating a risk of wrinkle formation or ruptures.

This is achieved according to the invention by making the transition between the bottom of the shallower portion and its side walls with a radius which, at least in the area adjacent to said transitional area, is substantially less than the radius of the central portion of the transitional area.

Such a trough-shaped sheet metal component can be deep-drawn without intermediate annealling and without risk of rupture or wrinkle formation by virtue of the fact that, in accordance with a method according to the invention, the second drawing step is carried out using pressure pads which are applied under the sheet metal component in the transitional area to hold, together with the punch, at least the side area of the transitional area during the drawing process and only permit working of the material in said side areas by bending.

By making the side edge in the transitional area as sharp as possible and using a pressure pad, a complete locking of the material is achieved, so that the result of the drawing in the second step is purely a displacement upwards of the edges of the pan.

Figure 1:
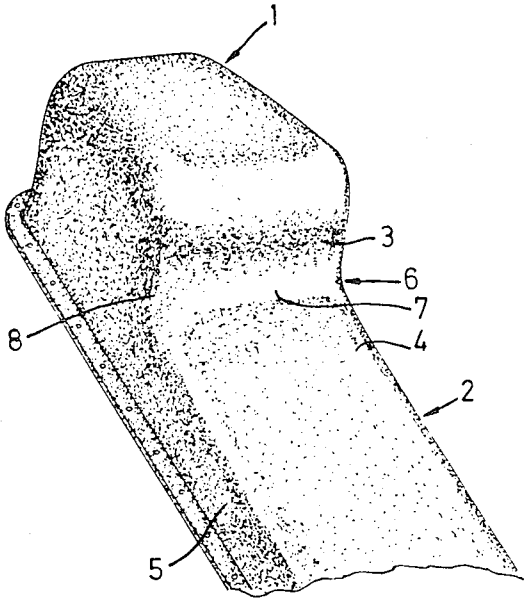
Figure 3:
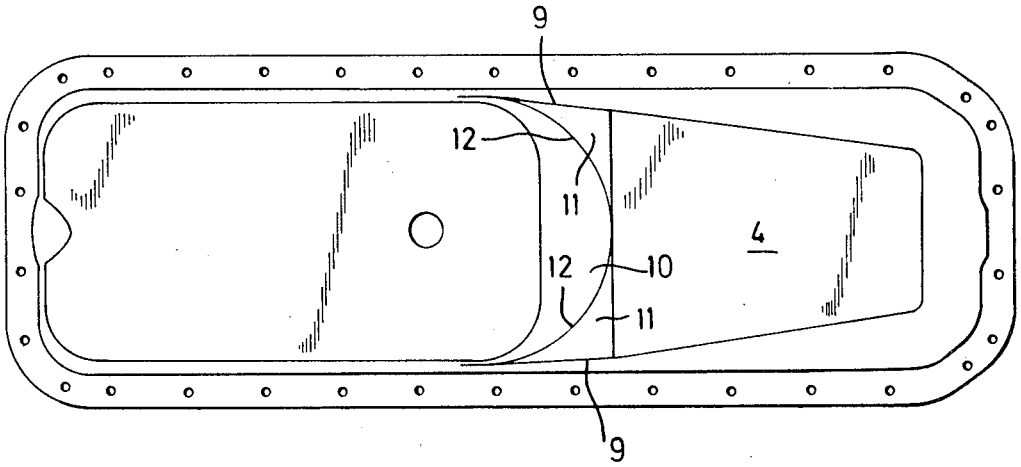

The invention will now be described in more detail with reference to the examples shown in the accompanying drawings, in which FIG. 1 is a perspective view from below a conventional oil pan, FIG. 2 is a view corresponding to FIG. 1 of an oil pan according to the invention, FIG. 3 is a plane view of the pan in FIG. 2, and FIGS. 4–6 schematic plane views as well as longitudinal and cross sections, illustrating the method of drawing the pan according to the invention.

FIG. 1 shows a conventional oil pan which has a deeper portion 1 and a shallower portion 2. Between the rear wall 3 of the deeper portion 1 and the bottom 4 of the shallower portion 2 and its side walls 5, there is a gently rounded transitional area, generally designated 6. This area 6 has approximately the same radius of curvature in the transition 7 to the bottom 4 as in the transition 8 to the side walls 5.

FIGS. 2 and 3 show an oil pan according to the invention. As can be seen from the figures, this oil pan differs from the one in FIG. 1 in that the transitional area 6 has a different form. Hence the transition between the bottom 4 of the shallower portion 2 and its side walls 5 is made with a very short radius, so that a relatively sharp edge 9 is formed. The central portion 10 of the transitional area 6 has, as does the oil pan i FIG. 1, a relatively long radius. Adjacent to the central area 10 there are flat, wedge-shaped sections 11 whose transitions 12 to the wall 3 of the deeper section have a short radius, making a relatively sharp transition.

Figure 6:
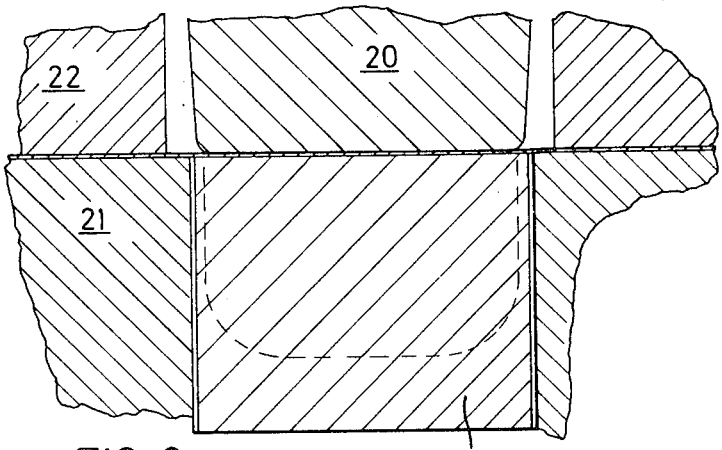
Figure 4:
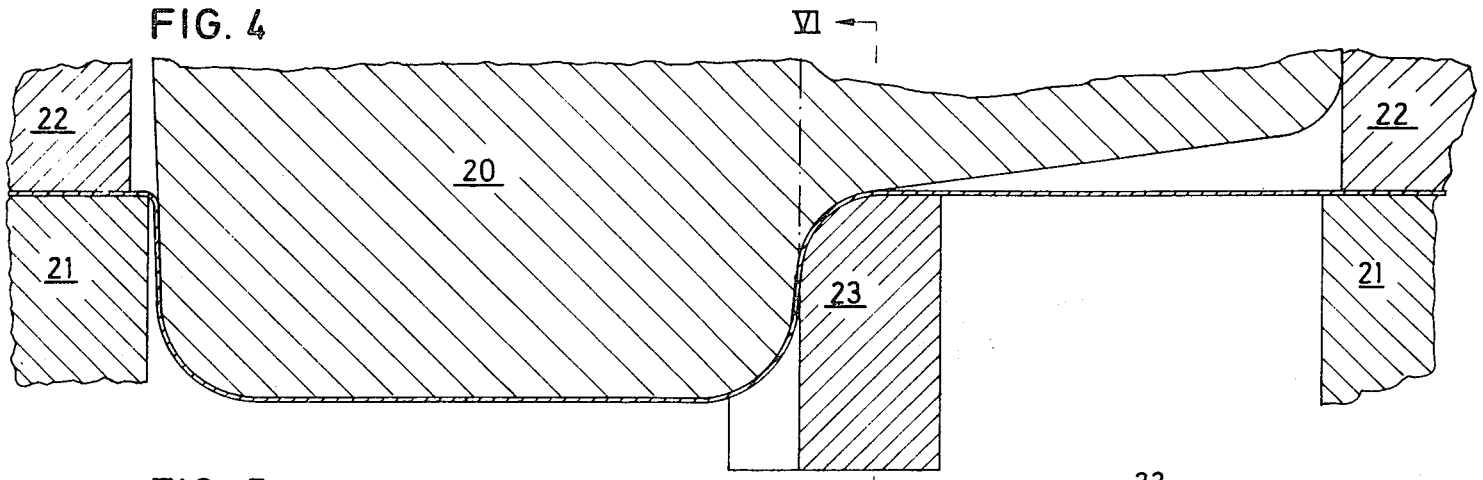
Figure 5:
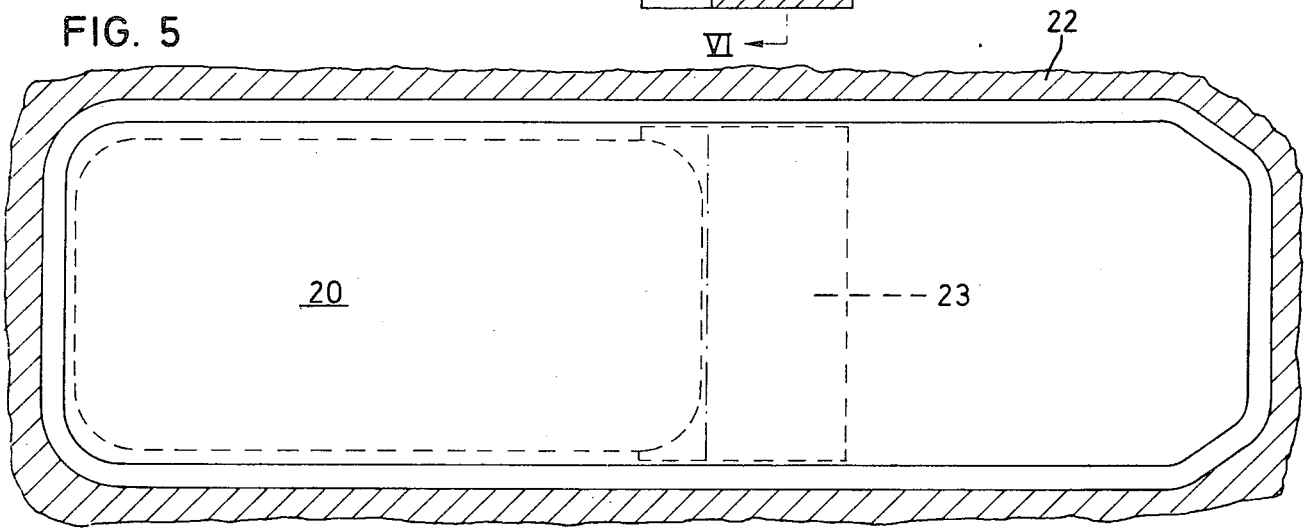

By giving the pan the form described, it can be deep-drawn from a flat sheet metal blank in the manner illustrated schematically in FIGS. 4–6. In the figures, 20 designates the punch, 21 the die, 22 the blank-holder, and 23 a pressure pad.

In a two-step pressing operation, the pressing of the deeper portion 1 of the pan can be made in a conventional manner in a first step using a punch, which corresponds to the left-hand side of the punch 20 as divided by the dash-dot line in FIG. 4. FIG. 4 shows the position of the component parts immediately prior to the second drawing step. According to the invention a pressure pad 23 is used here which, together with the punch 20, holds tightly the material in the transitional area between the deeper and the shallower portions. The pressure pad is movable so that it can be moved downwards together with the punch. Thus a constant force is applied to the material by the pressure pad, which can be controlled either hydraulically or pneumatically. Due to the form of the pressure pad and the punch with relatively sharp transitions in the edge areas 9 of the oil pan, as shown best in FIG. 6, during the second step the material in the transitional area will only be worked by bending, so that the result is entirely an upward displacement of the edges of the pan.

Lately, laminated sheet metal has begun to be used in oil pans for combustion engines for the purpose of achieving quieter operation. Such sheet metal, which can consist of two layers of metal with an intermediate layer of plastic, is appreciably more difficult to shape than solid sheet metal. Oil pans of such laminated material can be made without difficulty by using the method according to the invention.

Finally, we would mention that the information that the drawing is done in two steps is not to be construed that the drawing must be done in two clearly separate steps using two different punches. It is also conceivable, within the scope of the invention, to use a drawing process in which the first and second steps are carried out in one sequence, i.e. without any definite halt, and with the same punch, with the pressure pad being applied to the latter stage of the drawing process.

What I claim is:

1. In a trough-shaped sheet metal component with a deeper and a shallower portion, for example an oil pan for combustion engines, comprising longitudinal side walls, forward and rear end walls and a transverse wall with a transitional area to the bottom of the shallower portion, the transition between the bottom of the shallower portion and its side walls having a radius which, at least in the area adjacent to said transitional area, is substantially less than the radius of the central portion of the transitional area; the improvement in which the transitional area between the bottom of the shallower portion and the transverse wall of the deeper portion has a greater radius over its central area than over its side areas, the transition between the bottom of the shallower portion and its side walls extending past said central transitional area so that flat, wedge-shaped portions of the bottom of the shallower portion are formed on either side of said central portion.

* * * * *